United States Patent [19]

Kanbe et al.

[11] 4,337,306

[45] Jun. 29, 1982

[54] DEVELOPING METHOD IN WHICH A BIAS IS ADJUSTABLE IN ACCORDANCE WITH A LATENT IMAGE AND AN APPARATUS THEREFOR

[75] Inventors: Junichiro Kanbe, Tokyo; Kozo Arao, Yokohama; Nagao Hosono, Chofu all of Japan

[73] Assignee: Canon Kabushiki Kaisha, Tokyo, Japan

[21] Appl. No.: 124,912

[22] Filed: Feb. 26, 1980

[30] Foreign Application Priority Data

Mar. 5, 1979 [JP] Japan ..... 54-25321

[51] Int. Cl.[3] ..... G03G 15/09

[52] U.S. Cl. ..... 430/122; 430/120; 118/653

[58] Field of Search ..... 430/120, 122; 118/653; 355/14 E, 3 DD

[56] References Cited

U.S. PATENT DOCUMENTS

| | | | |
|---|---|---|---|
| 3,893,418 | 7/1975 | Liebman et al. | 118/653 |
| 3,961,951 | 6/1976 | Mayer | 430/120 |
| 3,997,688 | 12/1976 | Gundlach et al. | 430/120 |
| 4,121,931 | 10/1978 | Nelson | 430/120 |
| 4,248,524 | 2/1981 | Takahashi | 430/31 |

*Primary Examiner*—John E. Kittle
*Assistant Examiner*—John L. Goodrow

[57] ABSTRACT

A developing method for developing the latent image on a latent image bearing member with a one-component developer characterized in that a developer carrier is installed with a space gap with respect to the latent image bearing member, and a bias phase acting to expedite the transition of the one-component developer from the developer carrier to the latent image bearing member and a bias phase acting conversely to said bias phase are alternately applied at a low frequency, said alternate biases being adjusted in accordance with the potential of the latent image on the latent image bearing member, and an apparatus therefor.

20 Claims, 23 Drawing Figures

DEVELOPING METHOD IN WHICH A BIAS IS ADJUSTABLE IN ACCORDANCE WITH A LATENT IMAGE AND AN APPARATUS THEREFOR

BACKGROUND OF THE INVENTION

1. Field of the Invention

This invention relates to a developing method and apparatus, and more particularly to a one-component developing method which is capable of providing a stable visible image for fluctuation of a latent image potential, and an apparatus therefor.

2. Description of the Prior Art

As seen in an electrophotographic apparatus, an electrostatic recording apparatus and other image formation apparatus, the potential of a latent image has been forced to fluctuate somewhat depending on the environment, the frequency of use of the apparatus, etc. and therefore, it has been necessary to adjust the image density in accordance with said fluctuation. Also, as regards the image density, etc., means is necessary for adjusting it in accordance with the type of an original and the liking of a utilizer. As such adjusting means, use has heretofore been made of a method of correcting the potential of the electrostatic latent image by mechanically varying the stop of an optical system or by varying the intensity of a light source. However, the former has a demerit of higher cost and the latter has a demerit that the light source is limited to a heat generation type light source such as a halogen lamp or the like.

SUMMARY OF THE INVENTION

It is an object of the present invention to solve such problems peculiar to the prior art.

It is another object of the present invention to provide a developing method which can provide visible images of high quality by the use of a novel developing process using a one-component developer (see, for example, assignee's U.S. patent application Ser. Nos. 58,434 and 58,435) and a very compact developing device and also can very easily effect the correction of the latent image potential by development, namely, the adjustment of the image density, on the basis of the essential principle of said developing process, and an apparatus therefor.

It is still another object of the present invention to provide a developing method for developing the latent image on a latent image bearing member with a one-component developer, characterized in that a developer carrier is disposed with a space gap with respect to the latent image bearing member, and a bias phase acting to expedite the transition of the one-component developer from the developer carrier to the latent image bearing member and a bias phase acting conversely to said bias phase are alternately applied at a low frequency, said alternate biases being adjusted in accordance with the density level of the latent image on the latent image bearing member, and an apparatus therefore.

It is a further object of the present invention to provide a developing method in which a latent image bearing member having a back electrode and a developer carrier having an electrically conductive portion are opposed to each other with a space gap therebetween and development is effected by applying to between said back electrode and said electrically conductive portion a low frequency alternate voltage having a phase acting to expedite the transition of developer from said developer carrier to said latent image bearing member and a phase acting to expedite the back transition of developer from said latent image bearing member to said developer carrier, characterized in that said alternate voltage is made variable in accordance with the potential of said latent image bearing member, and an apparatus therefor.

It is a further object of the present invention to provide a developing method in which the DC component of said alternate voltage is made variable in accordance with the surface potential of said latent image bearing member, and an apparatus therefor.

It is a further object of the present invention to provide a developing method in which the magnitude of said alternate voltage in the phase of transition or the phase of back transition is made variable in accordance with the surface potential of said latent image bearing member.

Thus, the present invention has the following effects.

(a) The adjustment of the image density in the developing method described in assignee's U.S. patent application Ser. Nos. 58,434 and 58,435 which uses a one-component developer and which is free of fog and very high in tone gradation can be very easily accomplished by detecting the latent image potential, and the effect of said developing method can be more enhanced.

(b) The potential or the density level of the latent image which fluctuates depending on the condition of use, the environmental conditions and the gradation of an original or an original light image can be detected to enable the visible image density desired by the operator to be obtained very easily and automatically.

(c) Unlike the conventional density adjustment, the density of the latent image can be detected to enable the denisty of the visible image to be automatically adjusted without troubling the operator.

Other objects and features of the present invention will become apparent from the following description of some embodiments of the invention taken in conjunction with the accompanying drawings.

DESCRIPTION OF THE PREFERRED EMBODIMENTS

First, the principle of the developing method utilized in the present invention will be described by reference to FIG. 1. In the lower portion of FIG. 1, there is shown a voltage waveform applied to a toner carrier. It is shown as a rectangular wave, whereas it is not restricted thereto. A bias voltage of the negative polarity having a magnitude of $V_{min}$ is applied at a time interval $t_1$, and a bias voltage of the positive polarity having a magnitude of $V_{max}$ is applied at a time interval $t_2$. When the image area charge formed on the image surface is positive and this is developed by negatively charged toner, the magnitudes of $V_{min}$ and $V_{max}$ are selected so as to satisfy the relation that $$V_{min}<V_L<V_D<V_{max} \quad (1)$$

where $V_D$ is the image area potential and $V_L$ is the non-image area potential. If so selected, at the time interval $t_1$, the bias voltage $V_{min}$ acts to impart a bias field with a tendency to expedite the contact of toner with the image area and non-image area of an electrostatic latent image bearing member and this is called the toner transition stage. At the time interval $t_2$, the bias voltage $V_{max}$ acts to impart a bias field with a tendency to cause the toner which has transited to the latent image bearing surface in the time interval $t_1$ to be returned to the toner carrier and this is called the back transition stage.

Figure 1:
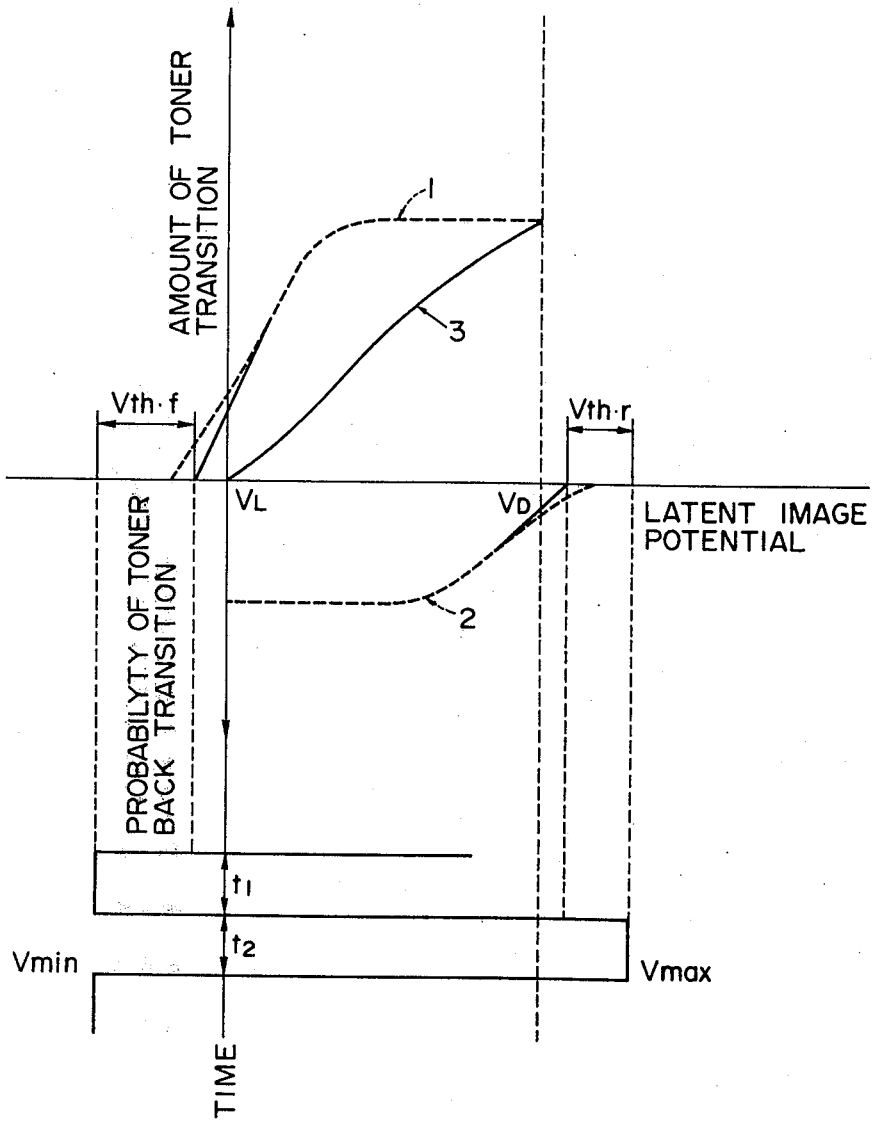
FIG. 1 illustrates the amount of transition of the toner and the characteristic of the degree of toner back transition for the potential of a latent image, as well as an example of the voltage waveform applied.

Vth·f and Vth·r in FIG. 1 are the potential threshold values at which the toner transits from the toner carrier to the latent image surface or from the latent image surface to the toner carrier, and may be considered potential values extrapolated by a straight line from the points of the greatest gradient of the curves shown in the drawing. In the upper portion of FIG. 1, the amount of toner transition at $t_1$ and the degree of toner back transition at $t_2$ are plotted with respect to the latent image potential.

The amount of toner transition from the toner carrier to the electrostatic image bearing member in the toner transition stage is such as curve 1 shown by broken line in FIG. 1. The gradient of this curve is substantially equal to the gradient of the curve when no bias alternate voltage is applied. This gradient is great and the amount of the toner transition tends to be saturated at a value intermediate $V_L$ and $V_D$ and accordingly, it is not suited for reproduction of half-tone images and provides poor tone gradation. Curve 2 indicated by another broken line in FIG. 1 represents the probability of toner back transition.

In the developing method according to the present invention, an alternating electric field is imparted so that such toner transition stage and toner back transition stage may be alternately repeated and in the bias phase $t_1$ of the toner transition stage of that alternating electric field, toner is positively caused to temporally reach the non-image area of the electrostatic latent image bearing member from the toner carrier (of course, toner is also caused to reach the image area) and toner is sufficiently deposited also on the half-tone potential portion having a low potential approximate to the light region potential $V_L$, whereafter in the bias phase $t_2$ of the toner back transition stage, the bias is caused to act in the direction opposite to the direction of toner transition to cause the toner which has also reached the non-image portion as described to be returned to the toner carrier side. In this toner back transition stage, as will later be described, the non-image area does not substantially have the image potential originally and therefore, when a bias field of the opposite polarity is applied, the toner which has reached the non-image area as described tends to immediately leave the non-image area and return to the toner carrier. On the other hand, the toner once deposited on the image area including the half-tone area is attracted by the image area charge and therefore, even if the opposite bias is applied in the direction opposite to this attracting force as described, the amount of toner which actually leaves the image area and returns to the toner carrier side is small. By so alternating the bias fields of different polarities at a preferred amplitude and frequency, the above-described transition and back transition of the toner are repeated a number of times at the developing station. Thus, the amount of toner transition to the latent image surface may be rendered to an amount of transition faithful to the potential of the electrostatic image. That is, there may be provided a developing action which may result in a variation in amount of toner transition having a small gradient and substantially uniform from $V_L$ to $V_D$ as shown by curve 3 in FIG. 1. Accordingly, practically no toner adheres to the non-image area while, on the other hand, the adherence of the toner to the half-tone image areas takes place corresponding to the surface potential thereof, with a result that there is provided an excellent visible image having a very good tone reproduction. This tendency may be made more pronounced by setting the clearance between the electrostatic latent image bearing member and the toner carrier so that it is greater toward the termination of the developing process and by decreasing and converging the intensity of the above-mentioned electric field in the developing clearance.

Figure 2A:
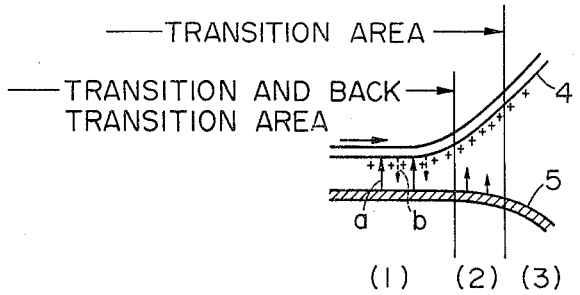
FIGS. 2A and 2B illustrate the process of the developing method used in the present invention.
Figure 2B:
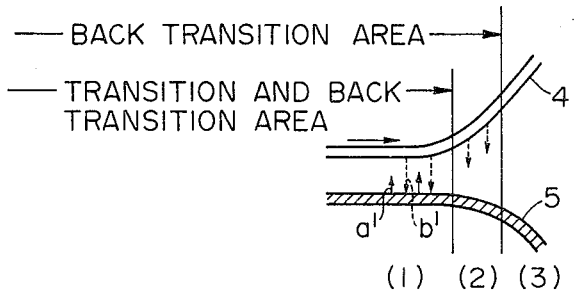
Figure 2C:
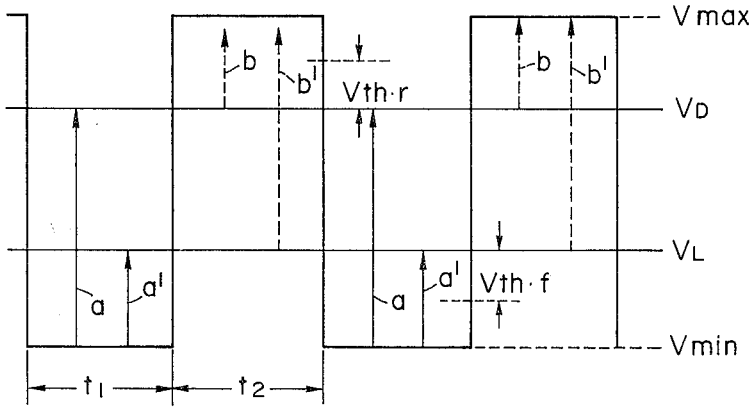
FIG. 2C shows an example of the applied voltage waveform.

An example of such developing process used in the present invention is shown in FIGS. 2A and 2B. As shown in FIGS. 2A and 2B, the electrostatic image bearing member 4 is moved in the direction of arrow through developing regions (1) and (2) to a region (3). Designated by 5 is a toner carrier. Thus, the electrostatic image bearing surface and the toner carrier gradually widen the clearance therebetween from their most proximate position in the developing station. FIG. 2A shows the image area of the electrostatic image bearing member and FIG. 2B shows the non-image area thereof. The direction of arrows shows the direction of the electric fields and the length of the arrows indicates the intensity of the electric fields. It is important that the electric fields for the transition and back transition of the toner from the toner carrier are present also in the non-image area. FIG. 2C shows a rectangular wave which is an example of the waveform of the alternate current applied to the toner carrier, and schematically depicts, by arrows in the rectangular wave, the relation between the direction and intensity of the toner transition and back transition fields. The shown example refers to the case where the electrostatic image charge is positive, whereas the invention is not restricted to such case. When the electrostatic image charge is positive, the relations between the image area potential $V_D$, the non-image area potential $V_L$ and the applied voltages $V_{max}$ and $V_{min}$ are set as follows:

$$|V_{max}-V_L|>|V_L-V_{min}|$$

$$|V_{max}-V_D|<|V_D-V_{min}| \quad (2)$$

In FIGS. 2A and 2B, a first process in the development occurs in the region (1) and a second process occurs in the region (2). In the case of the image area shown in FIG. 2A, in the region (1), both of the toner transition field a and the toner back transition field b are alternately applied correspondingly to the phase of the alternate field and the transition and back transition of the toner result therefrom. As the developing clearance becomes greater, the transition and back transition fields become weaker and the toner transition is possible in the region (2) while the back transition field sufficient to cause the back transition (below the threshold value $|V_{th\cdot r}|$) becomes null. In the region (3), the transition neither takes place any longer and the development is finished.

In the case of the non-image area shown in FIG. 2B, in the region (1), both the toner transition field a' and the toner back transition field b' are alternately applied to create the transition and back transition of the toner. Thus, fog is created in this region (1). As the clearance is wider, the transition and the back transition field become weaker and when the region (2) is entered, the toner back transition is possible while the transition field sufficient to cause transition (below the threshold value) becomes null. Thus, in this region, fog is not substantially created and the fog created in the region (1) is also sufficiently removed in this stage. In the region (3), the back transition neither takes place any longer and the development is finished. As regards the half-tone image area, the amount of toner transition to the final latent image surface is determined by the magnitudes of the amount of toner transition and the amount of toner back transition corresponding to that potential, and after all, there is provided a visible image having a small gradient of curve between the potentials $V_L$ to $V_D$, as shown by curve 3 in FIG. 1, and accordingly having a good tone gradation.

In this manner the toner is caused to fly over the developing clearance and is caused to temporally reach the non-image area as well to improve the tone gradation, and in order that the toner having reached the non-image area may be chiefly stripped off toward the toner carrier, it is necessary to properly select the amplitude and alternating frequency of the alternate bias voltage applied. Results of the experiment in which the effect of the present invention has clearly appeared by such selection will be shown below.

Figure 3A:
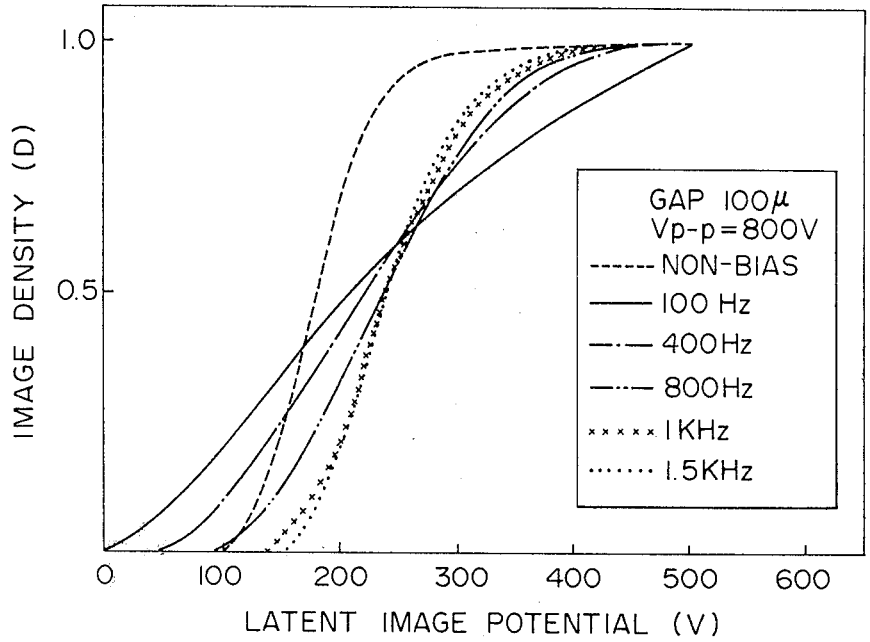
FIGS. 3A and 3B show the characteristic of the electrostatic image potential versus image density as the result of the experiment effected on the developing method used in the present invention, with the frequency of the applied alternate electric field varied.
Figure 3B:
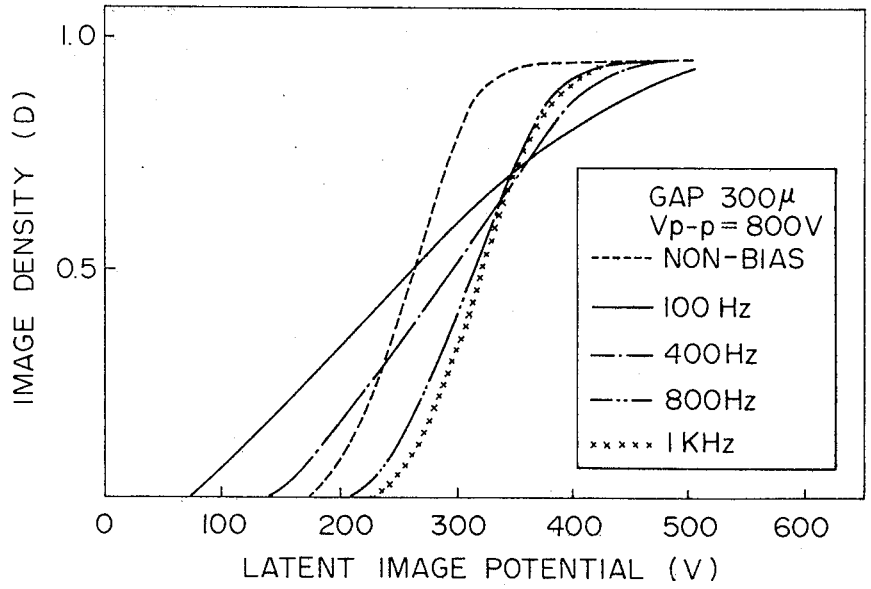

FIGS. 3A and 3B show the plotted results of the measurement of the image reflection density D with respect to electrostatic image potential V, effected with the amplitude of the applied alternate voltage fixed and with the frequency thereof varied. These curves will hereinafter be called the V-D curves. The experiment was carried out under the following construction. A positive electrostatic charge latent image is formed on a cylindrical electrostatic image formation surface. The toner used is a magnetic toner to be described hereinafter (which contains 30% magnetite), and such toner is applied onto a non-magnetic sleeve to a thickness of about 60μ, the non-magnetic sleeve enveloping therein a magnet, and negative charge is imparted to the toner by the friction between the toner and the sleeve surface. The result when the minimum developing clearance between the electrostatic image formation surface and the magnetic sleeve is maintained at 100μ is shown in FIG. 3A, and the result when such minimum developing clearance is maintained at 300μ is shown in FIG. 3B. The magnetic flux density in the developing station resulting from the magnet surrounded by the sleeve is about 700 gausses. The cylindrical electrostatic image formation surface and the sleeve are rotated substantially at the same velocity which is about 110 mm/sec. Thus, after having passed through the minimum clearance in the developing station, the electrostatic image formation surface gradually goes away from the toner carrier. The alternate electric field applied to this sleeve comprises a sine wave of amplitude $V_{p\text{-}p}=800$ V (peak-to-peak value) with a DC voltage of +200 V superimposed thereon. FIG. 3 shows the V-D curves when the alternating frequency of the applied voltage is 100 Hz, 400 Hz, 800 Hz, 1 KHz and 1.5 KHz (FIG. 3B only) and the V-D curve when no bias field is applied but conduction occurs through the back electrode of the electrostatic image formation surface and the sleeve.

From these results, it is seen that when no bias field is applied, the gradient or so-called γ value of the V-D curves is very great but by applying an alternate field of low frequency, the γ value is made smaller to greatly enhance the tone gradation. As the frequency of the extraneous field is increased from 100 Hz, the γ value becomes gradually greater to reduce the effect of enhancing the harmony and, when the clearance is 100μ and when the frequency exceeds 1 KHz under the amplitude $V_{p\text{-}p}=800$ V, that effect becomes weak; when the clearance is 300μ and when the frequency reaches the order of 800 Hz, that effect is also reduced; and when the frequency exceeds 1 KHz, the effect of harmony becomes weak. This may be considered to be attributable to the following reason. In the developing process during which an alternate field is applied, when the toner repeats adherence and separation in the clearance between the sleeve surface and the latent image formation surface, finite time is necessary to positively effect the reciprocating movement thereof. Particularly, the toner which transits by being subjected to a weak electric field takes a relatively long time to positively effect the transition.

An electrostatic field exceeding a threshold value which will cause transition of the toner is produced from the half-tone image area, but the electrostatic field is relatively weak. To cause the toner to reach the half-tone image area, it is necessary that the toner particles moved relatively slowly by being subjected to the electrostatic field positively transit to the image area within one-half period of the applied alternate field. For this purpose, where the amplitude of the alternate field is constant, a lower frequency of the alternate field is more advantageous and accordingly, as shown by the results of the experiment, a particularly good tone gradation is provided for an alternate field of low frequency. This speculation is justified by the comparison between the results of the experiment shown in FIGS. 3A and 3B. The results shown in FIG. 3B have been obtained under the same conditions as those shown in FIG. 3A except that the clearance between the electrostatic image formation surface and the sleeve surface is as great as 300μ. The wider clearance results in a lower intensity of the electric field to which the toner is subjected. The wider clearance further results in a longer distance of jump and after all, longer time of transition. As is actually apparent from FIG. 3B, the γ value becomes considerably great for the order of 800 Hz and when 1 KHz is exceeded, the γ value becomes almost equal to that when no alternate voltage is applied. Therefore, in order to obtain the same effect of enhanced tone reproduction as that when the clearance is narrow, it is preferable to reduce the frequency as will later be described or to increase the intensity (amplitude) of the alternate voltage.

On the other hand, too low a frequency does not result in sufficient repetition of the reciprocating movement of the toner during the time the latent image formation surface passes through the developing station, and tends to cause irregular development to be created in the image by the alternate voltage. As the result of the foregoing experiment, generally good images have been provided down to the frequency of 40 Hz, and when the frequency is below 40 Hz, irregularity has been created in the visible image. It has been found that the lower limit of the frequency for which no irregularity is created in the visible image depends on the developing conditions, above all, the developing speed (also referred to as the process speed, $V_p$ mm/sec.). In the present experiment, the velocity of movement of the electrostatic image formation surface has been 110 mm/sec. and therefore, the lower limit of the frequency is $40/110 \times V_p \approx 0.3 \times V_p$. As regards the waveform of the alternate voltage applied, it has been confirmed that any of sine wave, rectangular wave, saw-tooth wave or asymmetric wave of these is effective.

Such application of the alternate bias of lower frequency brings about remarkable enhancement of the tone gradation, but the voltage value thereof must be properly set. That is, too great a value for the $|V_{min}|$ of the alternate bias may result in an excessive amount of toner adhering to the non-image area during the toner transition stage and this may prevent sufficient removal of such toner in the developing process, which in turn may lead to fog or stain created in the image. Also, too great a value for $|V_{max}|$ would cause a great amount of toner to be returned from the image area, thus reducing the density of the so-called solid black portion. To prevent these phenomena and to sufficiently enhance the tone gradation, $V_{max}$ and $V_{min}$ may preferably and reasonably be selected to the following degrees:

$$V_{max} \approx V_D + |V_{th\cdot r}| \quad (3)$$

$$V_{min} \approx V_L + |V_{th\cdot f}| \quad (4)$$

Vth·f and Vth·r are the potential threshold values already described. If the voltage values of the alternate bias are so selected, the excess amount of toner adhering to the non-image area in the toner transition stage and the excessive amount of toner returned from the image area in the back transition stage would be prevented to ensure obtainment of proper development.

The foregoing description has been made with respect to the case where the image area potential VD is positive, whereas the present invention is not restricted thereto but it is also applicable to a case where the image area potential is negative and in this latter case, if the positive of the potential is small and the negative of the potential is great, the present invention is equally applicable. Therefore, when such image area charge is negative, the aforementioned formulas (1)–(4) are represented as the following formulas (1')–(4').

$$V_{max} > V_L > V_D > V_{min} \quad (1')$$

$$\left.\begin{array}{l} |V_{min} - V_L| > |V_L - V_{max}| \\ |V_{min} - V_D| < |V_L - V_{max}| \end{array}\right\} \quad (2')$$

$$V_{min} \approx V_D - |V_{th\cdot r}| \quad (3')$$

$$V_{max} \approx V_L + |V_{th\cdot f}| \quad (4')$$

Figure 4A:
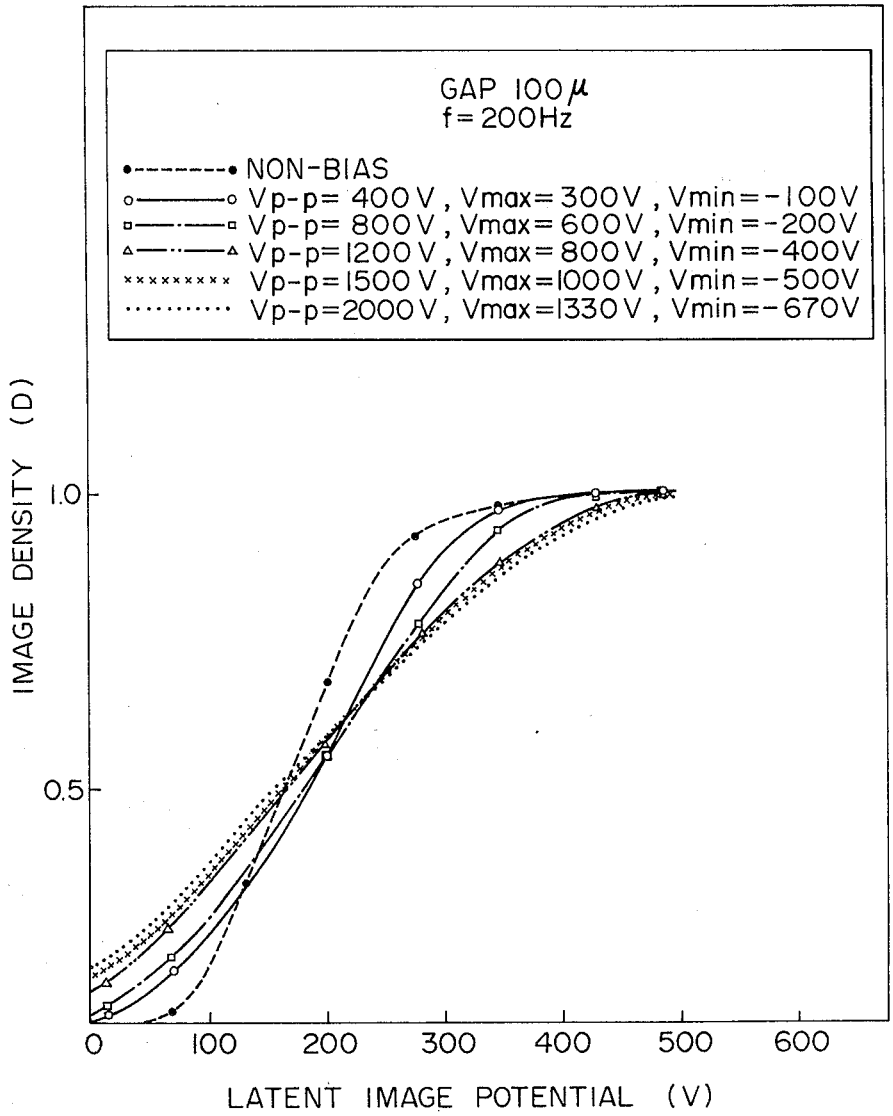
FIGS. 4A and 4B show the characteristic of the electrostatic image potential versus image density as the result of the experiment effected on the developing method used in the present invention, with the amplitude of the applied alternate electric field varied.
Figure 4B:
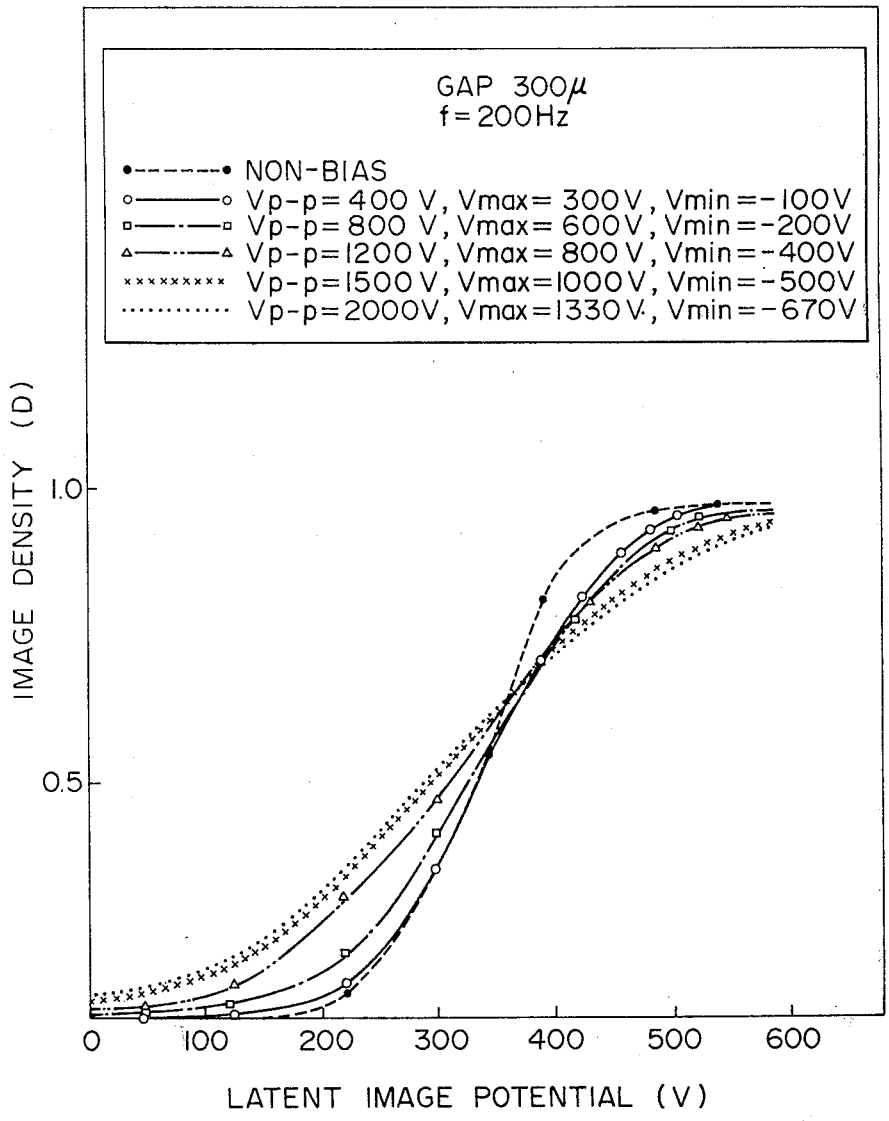

Proper development in this development method is shown by the results of the experiment. FIGS. 4A and 4B show the V-D curves when the amplitude $V_{p\text{-}p}$ of the alternate field is varied with the frequency thereof fixed (200 Hz). FIG. 4A shows the result in the case where the developing clearance is set to 100μ, and FIG. 4B shows the result in the case where the developing clearance is set to 300μ. The other conditions are the same as those in FIGS. 3A and 3B. First, when the developing clearance is relatively small, and when the amplitude $V_{p\text{-}p}$ exceeds 400 V, the result of enhanced tone gradation appears as compared with the case where no electric field is applied. When the $V_{p\text{-}p}$ exceeds 1500 V, the tone gradation is good but fog begins to appear in the non-image area, and when the $V_{p\text{-}p}$ exceeds 2000 V, more fog appears. Prevention of such fog may be accomplished by increasing the alternating frequency to higher than 200 Hz.

A wider developing clearance of 300μ has given rise to the effect of enhanced tone gradation from $V_{p\text{-}p}=400$ V or higher and has given birth to visible images of good quality having good tone gradation and free of fog for the order of 800 V of the $V_{p\text{-}p}$. If the $V_{p\text{-}p}$ exceeds 2000 V, the tone gradation is good but fog is created and therefore, in such a case, it is necessary to increase the alternating frequency.

When the developing clearance d is relatively great like this, it is advisable to provide a greater value of the $V_{p\text{-}p}$ of the applied voltage and providing a higher value for f than when the developing clearance d is small.

In order to provide enhanced tone gradation of the image, it is necessary to set the alternating frequency and amplitude value of the applied alternate voltage to proper ranges, and it has been found that, depending on the properties of the image, the relation between the frequency and amplitude value of the applied voltage may be selectively changed over within an appropriate range. That is, when the relation between the frequency and the voltage value of the alternate voltage are studied more strictly, it has become clear that the developing characteristic (V-D curves) can be selected arbitrarily by those values.

The details of embodiments of the present invention will hereinafter be described by reference to the drawings.

Figure 5:
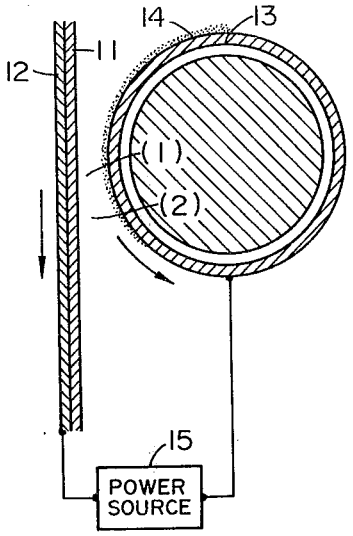
FIG. 5 illustrates the principle of the developing method according to the present invention.

FIG. 5 schematically show the developing method according to an embodiment of the present invention. Designated by 11 is a latent image bearing member bearing an electrostatic image or the like thereon, and designated by 12 is a back electrode thereof movable in the direction of arrow. Denoted by 13 is a developer carrier carrying thereon so-called one-component developer 14 having no carrier but comprising toner particles alone. In this case, the developer carrier is formed of an electrically conductive material such as metal or electrically conductive rubber. Designated by 15 is a power source for applying an extraneous alternate voltage to between the members 12 and 13. The relation between the magnitude of the electrostatic image potential and the magnitude of the extraneous alternate voltage applied is as shown in FIG. 2B. As already described, the extraneous alternate voltage, at the phase $t_1$, acts to expedite the transition of the developer from the developer carrier 13 to the latent image bearing member 11, and at the phase $t_2$, acts to return the developer from the latent image bearing member 11 to the developer carrier 13. In FIG. 5, during the time that the latent image bearing member 11 shifts from an area (1) at which it is most proximate to the developer carrier 13 to an area (2) at which the distance between the two members is greater, the phases $t_1$ and $t_2$ are repeated, whereby development of the latent image bearing member 11 is completed, and at the area (1), transition of the developer from the developer carrier to the latent image bearing occurs in both of the image area and the non-image area, and in the course during which the latent image bearing member passes through the area (2), the developer which has transited to the non-image area is completely returned to the developer carrier. The image obtained through such process is very excellent in thin line reproduction and tone reproduction, as already described. The details of this developing method are described in our U.S. patent application Ser. Nos. 58,434 and 58,435.

Figure 6A:
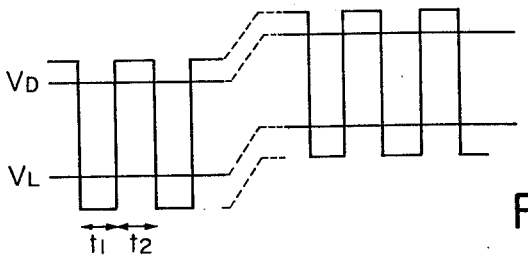
FIGS. 6(*a*)–(*c*) illustrate three modes of adjusting an alternate bias voltage in accordance with the fluctuation of the latent image potential.
Figure 6B:
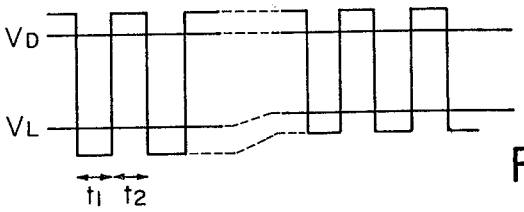
Figure 6C:
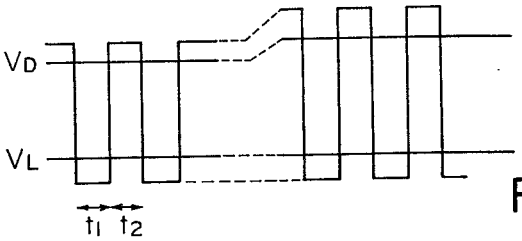
Figure 7A:
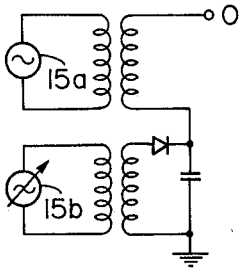
FIGS. 7(*a*), (*c*) and (*e*) are diagrams showing examples of the circuit for effecting such adjustment, and FIGS. 7(*b*), (*d*) and (*f*) show the output waveforms of the circuits.
Figure 7B:
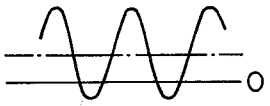
Figure 7C:
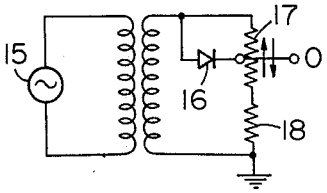
Figure 7D:
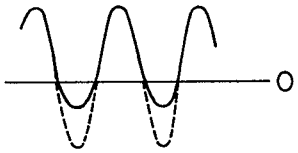
Figure 7E:
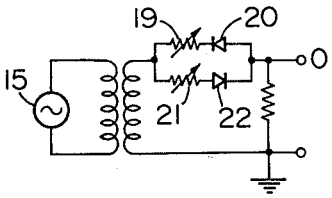
Figure 7F:
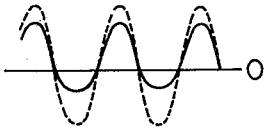

FIGS. 6(*a*), (*b*) and (*c*) show a method for providing a stable quality of image by varying the extraneous alternate voltage when the latent image potential has been varied by some factor such as a variation in environment, characteristic of the photosensitive medium, or the like.

FIG. 6(*a*) refers to a case where when the image area potential $V_D$ and non-image area potential $V_L$ (hereinafter referred to as the dark potential and light potential, respectively) are varied by said factor, those variations tend to shift to the same degree. For this, the alternate voltage applied may be shifted by substantially the same amount as the variation thereof, or in other words, the DC level of the alternate voltage may be shifted, and such an example is shown in FIG. 6(*a*).

FIG. 6(*b*) refers to a case where only the light potential $V_L$ tends to be varied. In this case, the voltage value of the extraneous alternate voltage at the phase $t_2$ may be varied in accordance with the fluctuation of the light potential.

FIG. 6(*c*) refers to a case where only the dark potential $V_D$ tends to fluctuate and in this case, the voltage value of the extraneous alternate voltage at the phase $t_1$ may be varied in accordance with the fluctuation of the dark potential. The method for varying the extraneous alternate voltage may be of the type in which the operator effects dial adjustment. In this case, there is also a merit that an image density corresponding to the original density or the liking of the user can be provided. On the other hand, a type in which the latent image potential is detected and the alternate voltage is automatically varied by a control circuit may be adopted. The method of measuring the latent image potential is disclosed, for example, in U.S. Pat. Nos. 2,956,487; 3,788,739; 3,944,354; 4,000,944 and U.S. patent application Ser. Nos. 832,984 and 922,272.

FIGS. 7(*a*)–(*f*) show model-like examples of the circuit for varying the alternate voltage and the voltage waveforms provided by these circuit examples.

FIG. 7(*a*) shows an example of the circuit of the type in which a DC voltage is superimposed on a sine wave AC voltage, and FIG. 7(*b*) shows the output waveform provided thereby. The input comprises two AC power sources 15*a* and 15*b*, and by making variable the voltage of one of these 15*b*, the DC component of the alternate voltage is made variable. This corresponds to the adjustment shown in FIG. 6(*a*). FIG. 7(*c*) shows a circuit of the type in which only the negative (−) side of a sine wave AC voltage is made small by a diode 16 and resistors 17, 18, and by sliding the resistor 17 of an output terminal 0, the negative (−) side voltage is made variable. The output waveform of this circuit is depicted in FIG. 7(*d*). This corresponds to the adjustment shown in FIG. 6(*b*).

FIG. 7(*e*) shows an example of the circuit in which the positive (+) or the negative (−) side of a sine wave AC voltage is independently adjusted, and the negative (−) side is distorted by varying the resistance value of a variable resistor 19 and the positive (+) side is distorted by varying the resistance value of a variable resistor 21, thereby obtaining the waveforms as depicted in FIG. 7(*f*). Designated by 20 and 22 in FIG. 7(*e*) are diodes.

Figure 8:
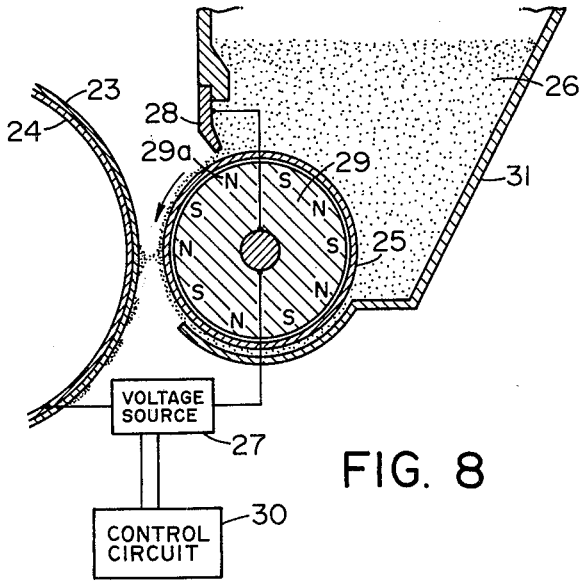
FIGS. 8–10 are cross-sectional including block diagrams, showing embodiments of the developing apparatus to which the developing method according to the present invention is applied.

Next, FIG. 8 shows an embodiment which incorporates such variable alternate voltage applying means and adjusting means therefor.

In FIG. 8, reference numeral 23 designates an electrostatic latent image bearing member having an insulating layer on a CdS layer, and 24 a back electrode thereof. The members 23 and 24 form a drum shape. Designated by 25 is a non-magnetic stainless metal sleeve having a magnet roll 29 therewithin. The electrostatic latent image bearing member 23 and the sleeve 25 are held with the minimum space gap therebetween maintained at 300μ by a well-known gap maintaining means. Designated by 26 is a one-component magnetic developer in a developing container 31. The developer comprises 70% by weight of styrene maleic acid resin, 25% by weight of ferrite, 3% by weight of carbon black and 2% by weight of negative charge controlling agent mixed and ground and further has 0.2% by weight of colloidal silica extraneously added thereto to enhance the fluidity thereof. Designated by 28 is an iron blade opposed to the main pole 29*a* (850 gausses) of the magnet roll 29 enclosed in the sleeve 25. The iron blade controls the thickness of the magnetic developer 26 applied onto the sleeve 25 by a magnetic force as is described in assignee's U.S. patent application Ser. No. 938,494. The clearance between the blade 28 and the sleeve 25 is maintained at about 240μ and the thickness of the developer layer applied onto the sleeve 25 by the blade 28 is about 100μ. Designated by 27 is a variable alternate voltage source and the voltage therefrom is applied to between the back electrode 24 and the conductive portion of the sleeve 25. A controller 38 is connected to the voltage source 35 to variably control the voltage applied therefrom as is shown in FIG. 7(*c*). The blade 28 and the sleeve 25 are at the same potential to prevent irregularity of application of the developer.

The average value of the electrostatic image potential is +500 V for the image area and OV for the non-image area. The extraneous alternate voltage comprises a sine wave of frequency 400 Hz and peak-to-peak 1500 V rendered into a distorted sine wave having an amplitude ratio of about 1.9:1 between the positive phase and the negative phase. By this embodiment, it was possible to obtain visible images of good quality which were excellent in tone gradation and which were clear and free of fog.

An example of the circuit for providing such a distorted sine wave is shown in FIG. 7(*c*) or 7(*e*). FIG. 7(*d*) or 7(*f*) illustrates the respective distorted output wave of such circuit.

Through a control circuit 30 including the circuit shown in FIG. 7 which is connected to the power source 27, it is possible to select the operator's favorite tone by dial adjustment, as already described. In this manner, an adjusting system which is simple and inexpensive as compared with the conventional adjusting mechanism resorting to an optical stop has been achieved.

Figure 9:
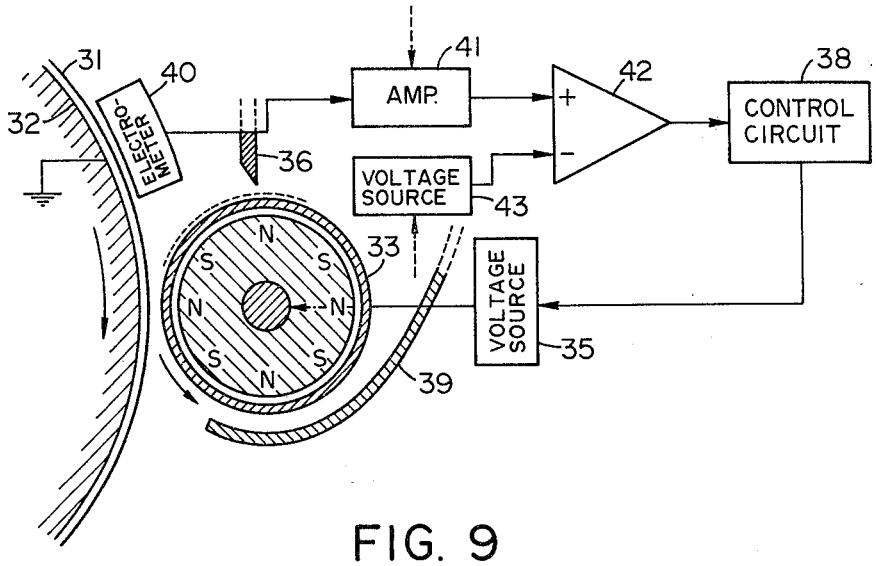

FIG. 9 shows an embodiment of the automatic control system which incorporates a surface potentiometer for detecting the surface potential of the latent image on the latent image bearing member. By perceiving that the non-image area potential $V_L$ most greatly affects the fluctuation of the quality of image, this detects the non-image area potential and automatically effects the bias control.

Figure 10:
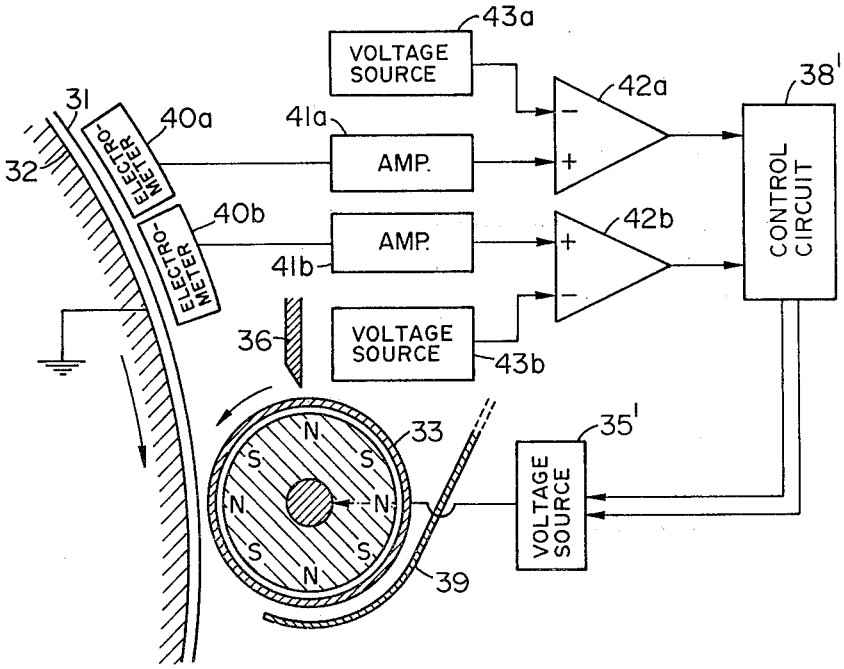

Designated by 40 is the aforementioned well-known surface potentiometer which detects the non-image area potential $V_L$ of the latent image bearing member 31, and 41 an amplifier for the detection output. Denoted by 43 is a voltage source for providing a standard potential as said non-image area potential, and it provides a predetermined voltage set to a value which causes no fog. Designated by 42 is a differential amplifier for comparing the outputs of the amplifier 41 and the voltage source 43 and amplifying the difference therebetween. Denoted by 38 is a control circuit which receives the output of the differential amplifier 42 and puts out a bias voltage to be applied to the sleeve 33. Designated by 35 is an alternate voltage source circuit which receives the output of the control circuit and automatically adjust only the magnitude of the negative component thereof and applies the same to said sleeve. The circuit 35 is similar to the circuit shown in FIG. 7(*c*). To automatically control the development further accurately, not only the non-image area potential but also the image area potential may be detected and both the positive and negative components of the bias may be adjusted. An example of the block diagram thereof is shown in FIG. 10. In FIG. 10, elements common to those shown in FIG. 9 are given similar reference characters and elements forming pairs are given similar reference characters with suffixes a and b attached thereto.

A pair of surface potentiometers 40*a* and 40*b* are provided in proximity to the surface of the latent image bearing drum 31 so that the surface potentials of the image area and the non-image area of the latent image on the drum may be independently detected, and the detected surface potentials are amplified by amplifiers 41*a* and 41*b* and compared with the output from standard voltage sources 43*a* and 43*b* by differential amplifiers 42*a* and 42*b* and if there is a difference therebetween, the output of a power source 35' is adjusted by a control circuit 38' as shown in FIG. 7(*e*) so as to compensate for said difference. The individual circuits and means constituting the respective blocks in FIGS. 9 and 10 may be well-known ones.

Figure 11A:
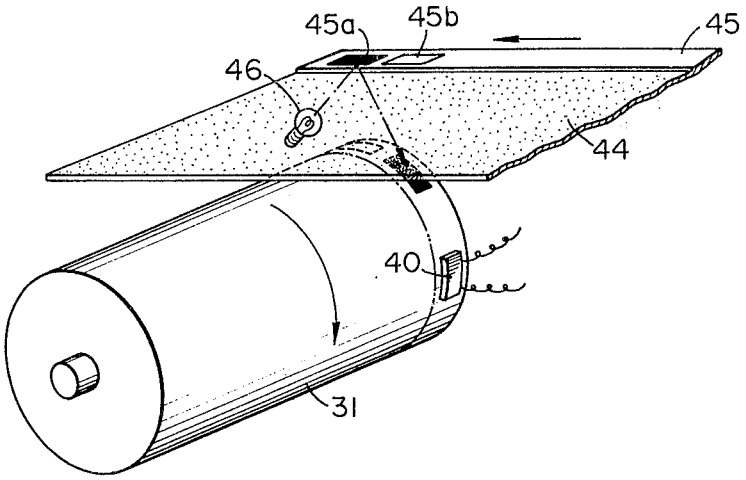
FIGS. 11(*a*) and (*b*) are perspective views exemplarily showing two forms of the surface potential detection applicable to the embodiments shown in FIGS. 9 and 10.
Figure 11B:
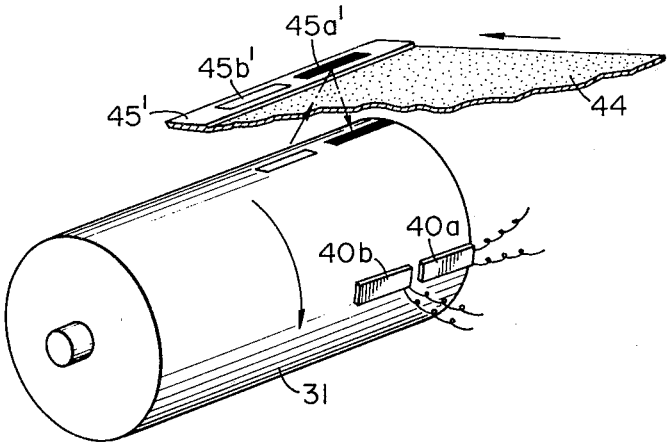

FIGS. 11(*a*) and (*b*) show the disposition of the surface potentiometers of FIGS. 9 and 10 and examples of the detection mode thereof. The construction of FIG. 11(*a*) is such that at one side edge outside of the original latent image formation portion of the photosensitive drum 31, a dark region and a light region as a latent image are formed circumferentially of the drum and these regions are successively detected by a surface potentiometer. In order that such dark and light regions may be formed on the photosensitive drum 31, a standard black plate 45*a* and white plate 45*b* are provided at the end 45 of an original carriage 44 and simultaneously with the exposure of an original, these standard plates are exposed onto the photosensitive drum and for example, a timing pulse synchronized with the movement of the original carriage is applied to the blocks 41 and 43 shown in FIG. 9 to successively detect the surface potentials of the dark region and light region. This detecting operation may be effected for each original latent image formation. In this example, if two surface potentiometers are successively disposed in the direction of rotation of the drum, detection and adjustment can of course be effected in the example of the circuit shown in FIG. 10.

The construction of FIG. 11(*b*) is such that the standard plates 45*a'* and 45*b'* shown in FIG. 11(*a*) are provided at the forward end edge 45' of the original carriage 44 in such a manner that they are juxtaposed axially of the photosensitive drum 31, and on that side of the drum which receives the reflected light from said plates, there are formed a dark region and a light region juxtaposed axially of the drum as shown. Designated by 40*a* and 40*b* are two surface potential sensors for detecting the surface potentials of these dark and light region latent images simultaneously. Detecting the outputs of these sensors and controlling the power source voltage can be automatically accomplished by the example of the circuit shown in FIG. 10.

We claim:

1. A developing method for developing a latent image bearing member into a visible image with a one-component developer carried by a developer carrier, comprising the steps of:

disposing the developer carrier with a space gap with respect to said latent image bearing member in a developing zone;

alternately moving the developer in opposite directions by applying to the developing zone an alternating voltage having a phase for effecting a forward transition of the one-component developer from the developer carrier into contact with the image bearing member, and a phase for effecting reverse transition of the one-component developer from the image bearing member into contact with the developer carrier; and controlling, in accordance with the potential of the latent image carried by the latent image bearing member, the voltage of at least one of the phases of the alternating phases, for maintaining the said forward and reverse transitions of developer with shifts in latent image potentials.

2. The developing method according to claim 1, wherein said control of said alternating voltage is accomplished by forming the latent image of a standard pattern simultaneously with an ordinary latent image formation and detecting the potential thereof.

3. The developing method according to claim 1, wherein said control of said alternating voltage is accomplished by forming a latent image, thereafter detecting the surface potential of said latent image and comparing the detected value with a standard potential.

4. The developing method according to claim 1, wherein said control of said alternating voltage is accomplished by forming the latent image of a standard pattern simultaneously with an ordinary latent image formation, automatically detecting the surface potential of the latent image of said pattern, comparing said surface potential with a perdetermined standard potential, and varying an alternating bias voltage automatically applied in response to the comparison output.

5. A method according to claim 1, wherein the voltage in the phase of forward transition is controlled in accordance with a surface potential of the image bearing member.

6. A method according to claim 1, wherein the voltage in the phase of reverse transition is controlled in accordance with a surface potential of the image bearing member.

7. A method according to claim 1, wherein the voltage in the phase of forward transition and the voltage in the phase of reverse transition are changed by said control.

8. The developing method according to claim 7, wherein a DC component of said alternate voltage is made variable in accordance with the surface potential of said latent image bearing member.

9. A developing method in which a latent image bearing member having a back electrode is opposed to a developer carrier having an electrically conductive portion with a clearance therebetween and development is effected while applying to said back electrode and said electrically conductive portion an alternating voltage having a phase acting to expedite the transition of developer from said developer carrier to said latent image bearing member and a phase acting to expedite the back transition of developer from said latent image bearing member to said developer carrier, said alternating voltage being made variable in accordance with the potential of said latent image bearing member, for maintaining both said transitions of developer with shifts in latent image potentials, and said laternating voltage having a frequency of 1.5 KHz or less so that the electric field in said developing clearance alternates both in the image area and the non-image area.

10. The developing method according to claim 9, wherein said frequency satisfies the relation that $$0.3 \times V_p \leqq f \leqq 1{,}000$$

where $V_p$ represents the peripheral speed of said latent image bearing member (mm/sec.) and f represents the frequency of said alternate electric field (Hz).

11. The developing method according to claim 9 or 10, wherein said alternate electric field satisfies when $V_D > V_{L1}$ $$|V_{max} - V_L| > |V_L - V_{min}|$$

$$|V_{max} - V_D| < |V_D - V_{min}|$$

and when $V_D < V_{L1}$ $$|V_{min} - V_L| > |V_L - V_{max}|$$

$$|V_{min} - V_L| < |V_D - V_{max}|$$

where $V_{max}$ represents the maximum value of the alternate electric voltage of said non-magnetic conductive member with the back electrode of said latent image bearing member as the standard, $V_{min}$ represents the minimum value of said voltage, $V_D$ represents the image area potential, and $V_L$ represents the non-image area potential.

12. The developing method according to claim 11, wherein said alternate voltage satisfies when $V_D > V_L$ $$V_{min} \approx V_L - |Vth \cdot f|$$

and when $V_D < V_L$ $$V_{max} \approx V_L + |Vth \cdot f|$$

where Vth·f represents the potential difference threshold value at which said developer is separated from the surface of said non-magnetic conductive member to transit to said latent image bearing surface.

13. The developing method according to claim 11, wherein said alternate voltage satisfies when $V_D > V_L$ $$V_{max} \approx V_D + |Vth \cdot r|$$

and when $V_D < V_L$ $$V_{min} \approx V_D - |Vth \cdot r|$$

where Vth·r is the potential difference threshold value at which said developer is separated from said latent image bearing surface to transit to said non-magnetic conductive member.

14. The developing method according to claim 9, wherein as a member for applying said developer to said nonmagnetic conductive member, use is made of a magnetic applicator member disposed at an opposed position to a pole of a magnet within said non-magnetic conductive member, and wherein a clearance of 50 to 500μ is maintained between the end of said magnetic applicator member and the surface of said non-magnetic conductive member.

15. The developing method according to claim 14, wherein the thickness of said developer applied onto said non-magnetic conductive member is greater than 50μ and smaller than 200μ.

16. The developing method according to claim 9, wherein the minimum clearance between said latent image bearing member and said non-magnetic conductive member is greater than 100μ and smaller than 500μ.

17. The developing method according to claim 9, wherein said magnet is stationarily supported within said non-magnetic conductive member and has a developing magnetic pole at a developing position opposed to the latent image.

18. A developing apparatus for developing a latent image into a visible image with a one-component developer, comprising a developer carrier disposed with a clearance with respect to a latent image bearing member, means for applying a low frequency alternate bias alternately having a phase acting to expedite the transition of developer from said developer carrier to said latent image bearing member and a phase acting conversely to said phase, and means for adjusting said alternate bias in accordance with the latent image level of said latent image bearing member.

19. The developing apparatus according to claim 18, wherein said means for adjusting said alternate bias has means for detecting the surface potential, means for comparing the output of said detecting means with a standard potential, and means for adjusting said alternate bias voltage in accordance with the comparison output.

20. The developing apparatus according to claim 18, wherein said means for adjusting said alternate bias is manually operable to vary the value of said bias in accordance with the type of the latent image.

* * * * *